US006948649B2

(12) United States Patent
Takahashi et al.

(10) Patent No.: US 6,948,649 B2
(45) Date of Patent: Sep. 27, 2005

(54) METHOD OF PRODUCING STEEL PIPES, AND WELDED PIPES

(75) Inventors: Nobuaki Takahashi, Kashima (JP); Akio Yamamoto, Kashima (JP); Tomoaki Ikeda, Kashima (JP); Tetsuya Fukuba, Kashima (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 269 days.

(21) Appl. No.: 10/247,373

(22) Filed: Sep. 20, 2002

(65) Prior Publication Data

US 2003/0062402 A1 Apr. 3, 2003

(30) Foreign Application Priority Data

Sep. 21, 2001 (JP) ..... 2001-289758

(51) Int. Cl.[7] ..... B23K 31/02; B21D 35/00; C21D 9/08

(52) U.S. Cl. ..... 228/173.4; 228/173.1; 228/141.1; 228/146; 72/367.1; 72/369; 148/320; 148/521; 148/590; 148/648

(58) Field of Search ..... 228/173.1, 141.1, 228/146, 173.4; 72/367.1, 369; 148/320, 519, 521, 590, 648

(56) References Cited

U.S. PATENT DOCUMENTS

| | | | | | |
|---|---|---|---|---|---|
| 3,837,931 | A | * | 9/1974 | Nemoto et al. | 148/211 |
| 4,464,209 | A | * | 8/1984 | Taira et al. | 428/683 |
| 4,533,405 | A | * | 8/1985 | Sponseller et al. | 148/337 |
| 5,794,840 | A | | 8/1998 | Hohl et al. | |
| 5,900,075 | A | * | 5/1999 | Koo et al. | 148/328 |
| 6,045,630 | A | * | 4/2000 | Fujiwara et al. | 148/336 |
| 2001/0030004 | A1 | * | 10/2001 | Kushida et al. | 148/325 |
| 2003/0131909 | A1 | * | 7/2003 | Yoshinaga et al. | 148/320 |

FOREIGN PATENT DOCUMENTS

| | | |
|---|---|---|
| EP | 0867520 A2 | 9/1998 |
| EP | 0867520 A3 | 3/1999 |
| JP | 9-1233 | 1/1997 |
| JP | 10-509768 | 9/1998 |
| JP | 10-324950 | 12/1998 |

* cited by examiner

*Primary Examiner*—L. Edmondson
(74) *Attorney, Agent, or Firm*—Burns, Doane, Swecker & Mathis, LLP

(57) ABSTRACT

The high yield ratio problem intrinsic in high-strength steel pipes is solved and a method of producing a steel pipe, while securing the pipe roundness is provided. A steel pipe produced from a steel plate by forming and welding is subjected to 0.3 to 1.2% of expansion and then to 0.1 to 1.0% of reduction. The steel pipe produced by this method has a structure in which martensite and/or bainite accounts for more than 80% as expressed in terms of area percentage, and has a yield strength of not lower than 551 MPa and a yield ratio of not higher than 93%. The pipe reduction is desirably carried out at a lower work ratio as compared with the pipe expansion.

8 Claims, 4 Drawing Sheets

A: Before Expansion

B: No-Reduction after Expansion

C: 0.1% Reduction after Expansion

D: 0.3% Reduction after Expansion

E: 0.5% Reduction after Expansion

A: Before Expansion

B: No-Reduction after Expansion

C: 0.1% Reduction after Expansion

D: 0.3% Reduction after Expansion

E: 0.5% Reduction after Expansion

METHOD OF PRODUCING STEEL PIPES, AND WELDED PIPES

BACKGROUND OF THE INVENTION

The present invention relates to a method of producing high-strength steel pipes which consists mainly of a martensitic and/or bainitic microstructure and can be used as high-strength line pipes of API X80 grade or higher. Steel pipes produced by this method are low in yield ratio and high in roundness or circularity in spite of their superior strength.

Those steel pipes, which are currently produced by the UOE process and used in practical pipelines, are up to API X70 grade. The practical use of API X80 grade steel pipes is found only in a few instances in the world. This is because high-strength steel pipes of X80 or higher grade become high in yield ratio and it is difficult to attain a yield ratio not higher than the tolerance limit prescribed in the relevant API specification, and because it is technologically difficult to establish basic characteristics of pipes, including strength, toughness and so forth. Furthermore, for putting steel pipes of X80 or higher grade to practical use, evaluation of the safety of such high-strength steel in actual application to pipelines is required.

However, for improving the conveyance efficiency, it is necessary to improve the strength of line pipes and to perform conveyance under high pressure. In recent years, even high-strength steel pipes of X100 or higher grade have been in demand.

According to the API (American Petroleum Institute), a steel of X60 grade should have a yield strength of 60 ksi (413 MPa) or higher. X80 grade means 80 ksi (551 MPa) or higher, and X100 grade means 100 ksi (689 MPa) or higher. At present, the API specification specifies steels up to X80 grade. The term "high-strength steel pipe", as used herein, means a steel pipe of X80 or higher.

High-strength steel pipes produced by the UOE process encounter new problems that have not been encountered by low-strength steel pipes. One of them is the increase in yield ratio.

For line pipes, it is prescribed, for providing safety, that the yield ratio, namely the value "(yield strength/tensile strength)×100 (%)", should be not higher than 93%. Low-strength steel pipes can easily meet this requirement (yield ratio of not higher than 93%). In the case of high-strength steel pipes consisting mainly of martensite and/or bainite, however, it is difficult to secure a yield ratio of not higher than 93%, since the increase in yield strength due to work hardening is significant.

In the UOE process, produced pipes are subjected to the step of expansion. The main objectives of expansion are to adjust the shape and form, typically roundness or circularity, and remove the residual stress resulting from welding. However, this expansion results in an increase in yield strength, hence an increase in yield ratio This tendency is more remarkable in high-strength steel pipes, consisting mainly of a martensitic or bainitic structure, than in low-strength steel pipes, having a ferrite-bainite or ferrite-pearlite structure.

In Laid-open Japanese Patent Application (JP-A) H09-1233 or U.S. Pat. No. 5,794,840, there is disclosed a method of adjusting the characteristics of steel pipes in steel pipe production by the conventional UOE process. The method comprises carrying out cold expansion and cold reduction in combination. However, as is evident from the examples described in the above-cited publication, the target of this method is a pipe of X70 grade. According to claim 2 therein, pipe reduction up to 2% is followed by expansion up to 4% and, according to claim 3, pipe expansion up to 2% is followed by reduction up to 4%.

Among the above methods, the method in which pipe expansion is carried out after reduction, when applied to high-strength steel pipes, causes an increase in yield ratio, leading to failure to meet the above-mentioned requirement (not higher than 93%). As for the method in which the pipe reduction follows expansion, on the other hand, application of such a high degree of pipe expansion as 2% and such a high degree of reduction as 4%, when applied to high-strength steel pipes, results in a marked decrease in the toughness of the steel pipes.

To sum up, the invention disclosed in JP-A H09-1233 or U.S. Pat. No. 5,794,840 is not concerned with a method of producing high-strength steel pipes consisting mainly of a martensitic and/or bainitic microstructure. The publication cited mentions nothing about how to maintain the yield ratio of high-strength steel pipes at low levels or secure the roundness thereof.

The influences of pipe expansion and reduction on the mechanical properties of steel pipes vary depending on the metallographic structure of the pipes. Therefore, the influences of pipe expansion and reduction on low-strength steel pipes having a ferrite-bainite or ferrite-pearlite structure and those on high-strength steel pipes consisting mainly of a martensitic and/or bainitic structure should be studied separately.

At present, there are no findings about a production process in which the problem of the yield ratio of high-strength steel pipes becoming excessively high can be solved. It is an object of the present invention to provide a method of producing steel pipes by which the above-mentioned high yield ratio problem intrinsic in high-strength steel pipes can be solved and, at the same time, the roundness of pipes can be secured.

SUMMARY OF THE INVENTION

The gist of the present invention consists in the following methods of producing steel pipes as specified under (1) to (3) and the welded steel pipe specified under (4).

(1) A method of producing a steel pipe having a microstructure at least 80%, as expressed in terms of area percentage, comprised of martensite and/or bainite and having a yield strength of not lower than 551 MPa; comprising a step of forming and welding a steel plate into a steel pipe, expanding, by 0.3 to 1.2%, the steel pipe, and then reducing the expanded steel pipe by 0.1 to 1.0%. The percentage of expansion or percentage of reduction means the value obtained by dividing the difference between the circumferential length of the pipe, after expansion or reduction, and that before expansion or reduction, by the circumferential length of the pipe before expansion or reduction, respectively, and multiplying the quotient by 100.

(2) A method of producing a steel pipe as specified above, wherein the percentage of reduction is smaller than the percentage of expansion.

(3) A method of producing a steel pipe as specified above, wherein the steel pipe after expansion and reduction has a yield strength of not lower than 689 MPa.

(4) A welded steel pipe produced by any of the methods specified above under (1) to (3).

DESCRIPTION OF THE PREFERRED EMBODIMENT

As mentioned above, the pipe expansion step, which is the final step in the conventional UOE process, causes an increase in yield ratio due to work hardening. With the increase in pipe strength, it becomes difficult to control the roundness within the intended range due to the plant capacity. The main objectives of the conventional pipe expansion step are relaxation of the residual stress in the vicinity of the welded portion welding and the securing of the roundness. In this step, however, the above-mentioned high yield ratio problem intrinsic in high strength steels, cannot be overcome.

The present inventors could obtain the following novel findings concerning the high yield ratio of high-strength steel pipes.

Figure 1:
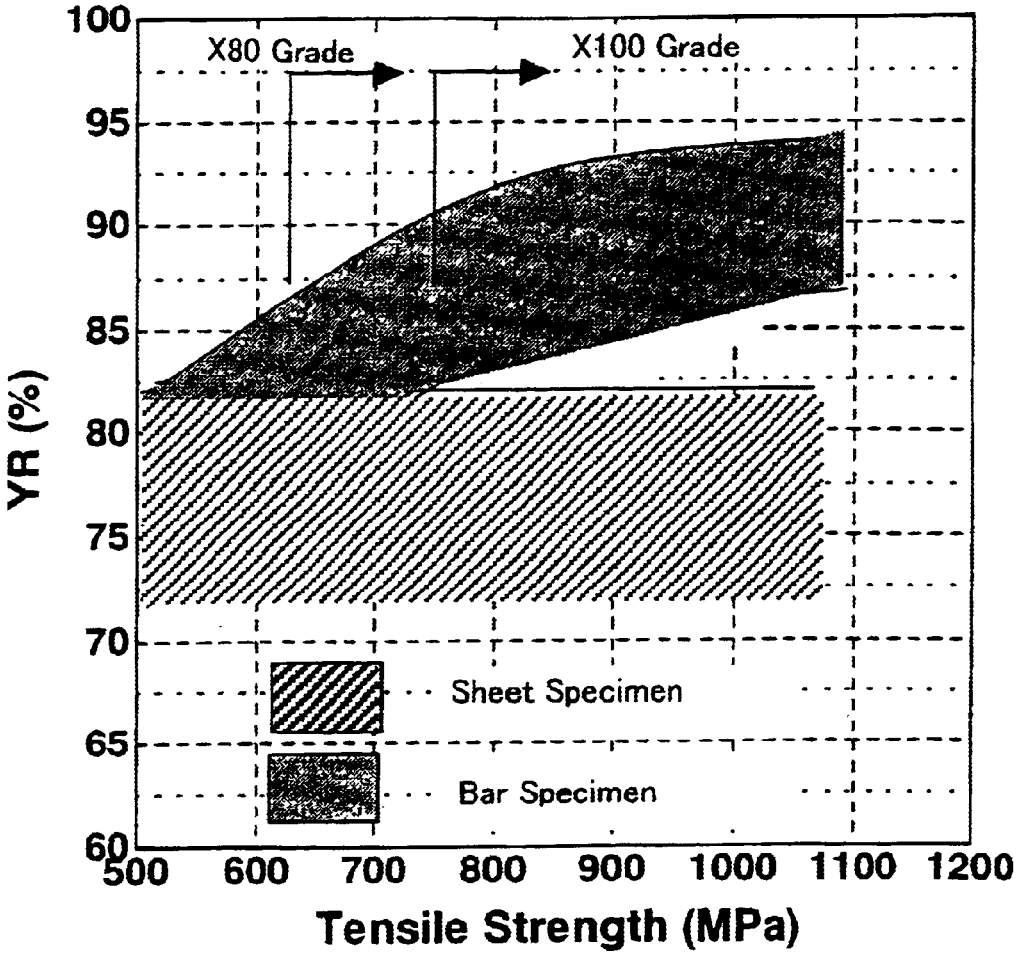
FIG. 1 is a graphic representation of the relationship between the tensile strength of a steel and the yield ratio thereof which depends on the shape of tensile testing specimens.

FIG. 1 is a graph summarizing the relationship between tensile strength and yield ratio (YR) as obtained by tensile testing of the round bar tensile test specimens and the API standard sheet tensile test specimens. The test specimens were collected, in the circumferential direction, from a large number of steel pipes which were produced in the UOE process and have different yield strengths.

As shown in FIG. 1, low-strength steels show no great difference in yield ratio (YR) between the testing of API standard sheet tensile test specimens and the round bar tensile test specimens. In the case of high-strength steels, however, round bar tensile test specimens give a very high yield ratio, markedly exceeding the API requirement that "the yield ratio should be not higher than 93%". On the other hand, sheet tensile test specimens show an approximately constant yield ratio, irrespective of tensile strength.

The above phenomenon occurs presumably because the API standard sheet tensile test specimens are prepared by bending back (straitening) curved specimens taken from steel pipes to a sheet form, whereas the round bar tensile test specimens are not subjected to working for such straitening. Thus, testing of the sheet tensile test specimens gives decreased yield ratio values because the test specimens are bent back when they are worked, so that the yield strength decreases, owing to the Bauschinger effect. In the sheet tensile test specimens, this decrease in yield strength is counterbalanced by the increase in yield strength upon pipe expansion, hence the yield ratio will hardly increase even if the strength increases. On the other hand, in testing of the round bar tensile test specimens, the yield ratio increases with increasing strength because the above-mentioned decrease in yield strength, due to the Bauschinger effect of the straitening working, is not caused so that the characteristics of each material itself are evaluated. With the high-strength steel to which the present invention is directed, a high yield ratio is attained expectedly due to the fact that the martensite or bainite structure, which is the main structure, has a high dislocation density, hence an extreme increase in strain sensitivity results.

In view of the above test results, it can be said that the use of the round tensile test specimens is recommended for accurately evaluating the mechanical properties of high-strength steel pipes of X80 or higher grade, in particular X100 or higher grade, although the yield ratio of a low-strength steel pipe of X70 or lower grade can be evaluated almost as accurately using either sheet tensile test specimens or round bar tensile test specimens. Therefore, the data on which the present invention relies on were all obtained by testing using round bar tensile test specimens. In the following, the test results are described.

1. Simulation of Pipe Expansion and Pipe Reduction

Using small test specimens, a test was carried out for simulating pipe expansion and pipe reduction following the UOE process. The test material (steel plate) had a tensile strength in the C direction of 900 MPa. Round bar test pieces of 14 mm in diameter, were collected from this steel plate in the C direction (circumferential direction), given a compressive strain of 0.3%, corresponding to O pressing, then given a tensile strain of 1.0% or 3.0%, corresponding to the pipe expansion step, and further given a compressive strain of 1.0% or 3.0% on the analogy of the pipe reduction step. After these workings, the round bar tensile test specimens of 6.35 mm in diameter were prepared, according to the ASTM specification, and subjected to tensile testing, and the relationship between compressive strain and yield ratio was studied. The results are shown in FIG. 2.

Figure 2:
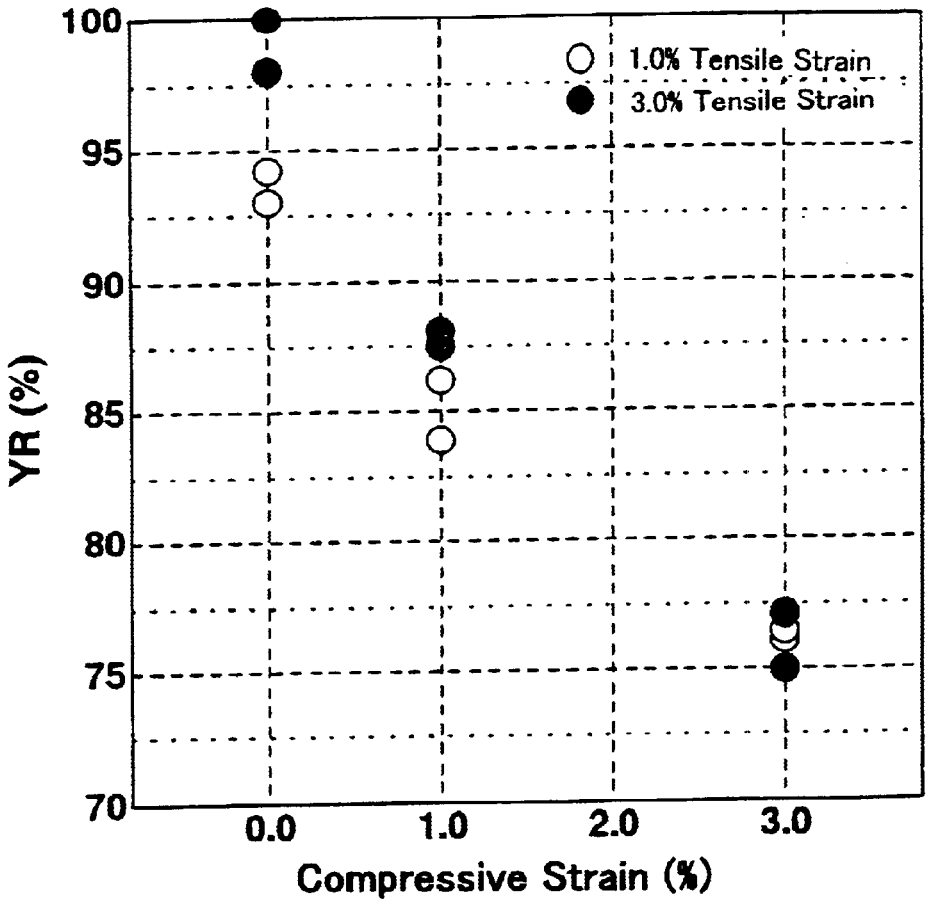
FIG. 2 is a graphic representation of the relationship between the compressive strain and the yield ratio in tensile testing of round bar specimens as found after imposing a tensile strain thereon.

As is apparent from FIG. 2, in the state given a tensile strain of 1.0% or 3.0% the yield ratio, which was 93 to 100%, markedly decreased when a compression strain was given. Thus, the yield ratio decreases upon pipe reduction following pipe expansion. Even the slight compressive strain of 1.0% caused a sharp reduction in yield ratio of 90% or below.

Figure 3:
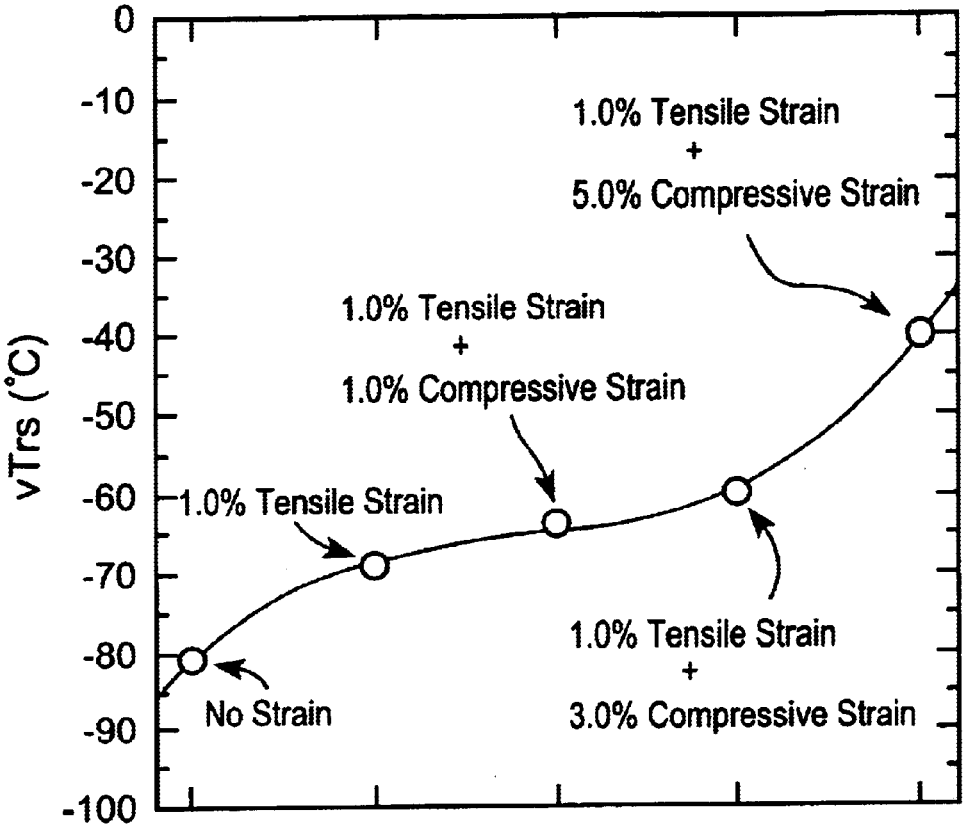
FIG. 3 is a graphic representation of the results of impact testing of test specimens after imposing a tensile strain and then a compressive strain thereon.

FIG. 3 is a graph showing the results of impact testing conducted using test pieces given a tensile strain and a compressive strain in the same manner as mentioned above. As shown in FIG. 2 discussed above, a high percentage of compression is desirable for lowering only the yield ratio. As is apparent from FIG. 3, however, working at a high percentage of compression results in a decrease in toughness.

2. Pipe Production Test

Based on the above simulation results with small test specimens, a pipe production test was carried out in an actual pipe production process. The production conditions were the same as those mentioned in the following EXAMPLE.

Figure 4:
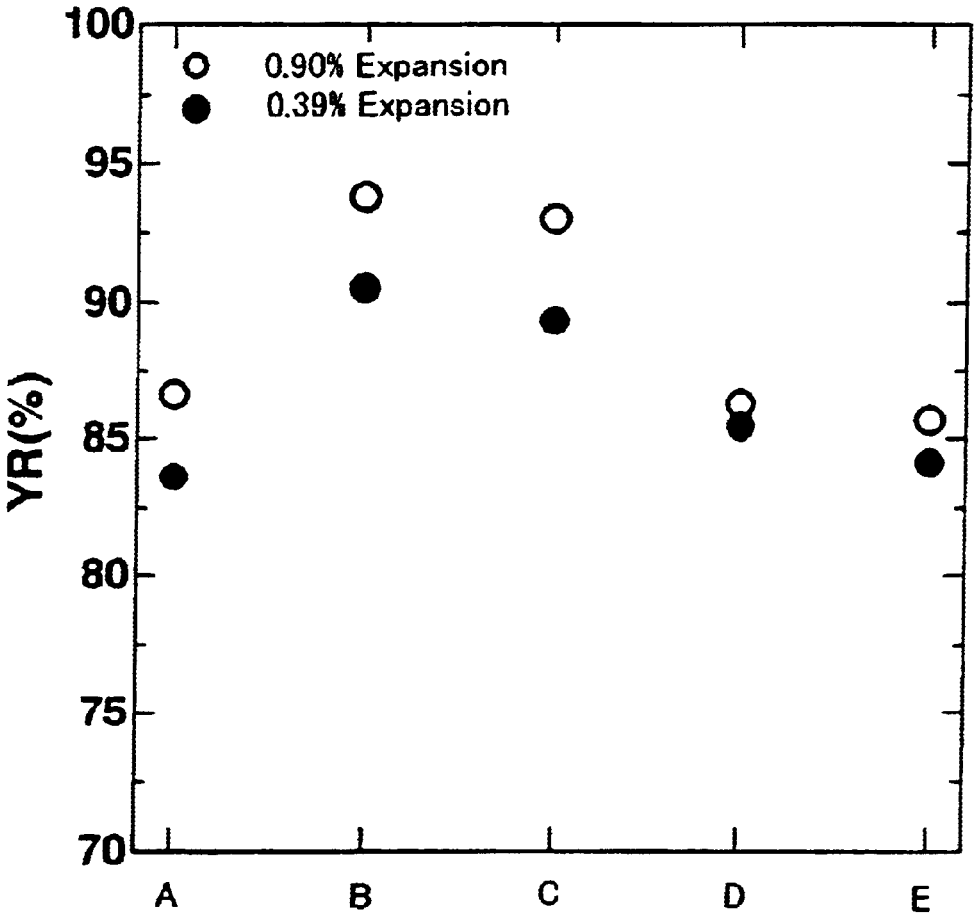
FIG. 4 is a graphic representation of the yield ratio values obtained after expansion and reduction using actual pipes.

In FIG. 4, there is shown the change in yield ratio as observed when a pipe expansion by the UOE process was followed by pipe reduction by 0.1%, 0.3% or 0.5% in an actual production process. It was confirmed that there was a tendency very similar to the results of the simulation test. Thus, it is evident that the yield ratio after expansion decreases through the step of pipe reduction. In the actual steel pipe production as well, a satisfactory effect can be produced at very low working ratios, as compared with the pipe expansion ratio and the reduction ratio which seem necessary for low-strength steel pipes.

In the actual pipe production process, local deformation proceeds with the increase in pipe reduction ratio, whereby it becomes difficult to secure the shape characteristics, such as roundness. Thus, for securing the basic performance characteristics and desired shape characteristics of steel pipes, the percentage of pipe reduction should not be excessive.

Further, when the yield ratio decreases excessively, it becomes necessary to increase the yield strength by adding an alloying component or components so that a prescribed level of yield strength can be secured. Generally, the toughness decreases with the increase in strength, so that it is difficult to secure good toughness with such a steel increased in strength as mentioned above.

3. Starting Steel Plate

A desirable starting steel plate to be used in producing high-strength steel pipes is a steel that has the following chemical composition. The "%" indicating the content of each component refers to "% by mass".

Steel plate consisting of C: 0.03–0.10%, Si: 0.05–0.5%, Mn: 0.8–2.0%, P: not more than 0.02%, S: not more than 0.01% and, further, one or more elements selected from among Cu: 0.05–1.0%, Ni: 0.05–2.0%, Cr: 0.05–1.0%, Mo: 0.03–1.0%, Nb: 0.005–0.1%, V: 0.01–0.1%, Ti: 0.005–0.03%, Al: not more than 0.06% and B: 0.0005–0.0030%, with the balance being iron and impurities.

The above steel plate may further contain not more than 0.005% of N and/or 0.0003–0.005% of Ca.

The effects of the components mentioned above are now described.

C: 0.03 to 0.10%

When the content of C is below 0.03%, the steel fails to have a desired microstructure, hence an intended strength can hardly be obtained. Conversely, when it exceeds 0.10%, the decrease in toughness becomes remarkable, the mechanical characteristics of the base metal are adversely affected and, at the same time, the occurrence of slab surface defects are promoted. Therefore, the appropriate C content range is 0.03 to 0.10%.

Si: 0.05 to 0.5%

Si serves as a deoxidizing agent for steel and also is a steel-strengthening component. When Si content is lower than 0.05%, insufficient deoxidation will result. When it is above 0.5%, banded martensite (martensite-austenite constituent) is formed in large amounts in the welding heat-affected zone, deteriorating the toughness. Therefore, the appropriate Si content range is 0.05 to 0.5%.

Mn: 0.8 to 2.0%

Mn is an essential element rendering a steel, tough and strong. At levels below 0.8%, the effect is insufficient and a desired microstructure and strength cannot be obtained. Conversely, at levels exceeding 2.0%, center segregation becomes remarkable, lowering the base metal toughness; the weldability also deteriorates. Therefore, appropriate Mn content is 0.8 to 2.0%.

P: not more than 0.02%

P is an impurity and, when its content exceeds 0.02%, center segregation becomes significant, leading to a decrease in base metal toughness; hot cracking may also be caused in the step of welding. Therefore, the P content should desirably be as low as possible.

S: not more than 0.01%

S is also an impurity and, when its content exceeds 0.01%, the tendency increases toward hydrogen-induced cracking of steel plates and toward hydrogen embrittlement cracking in the step of welding. Therefore, the S content should desirably be as low as possible.

Cu: 0.05 to 1.0%

Cu is a component which increases the strength of steel through solid solution hardening and through structural modification due to its increasing hardenability effect, without markedly impairing toughness of the steel. The level 0.05% is the minimum level for the production of this effect. On the other hand, when the Cu content exceeds 1.0%, copper checking occurs and slab surface defects are thereby induced. The copper checking can be prevented by low temperature heating of the slab but the conditions of steel plate production are restricted. Therefore, appropriate Cu content is 0.05 to 1.0%.

Ni: 0.05 to 2.0%

Like Cu, Ni is an element which strengthen the steel through solid solution hardening and through structural modification by its increasing hardenability effect, without markedly impairing the toughness of the steel. Such effect becomes significant at 0.05% or more. However, a level exceeding 2.0% increases the cost of the production of steel, hence is not practical.

Cr: 0.05 to 1.0%, Mo: 0.03 to 1.0%

Like Cu and Ni, Cr and Mo are elements which strengthen the steel through solid solution hardening and a structural modification by their increasing hardenability effect, without markedly impairing the toughness of the steel. At the respective levels of 0.05% or more and 0.03% or more, the effect becomes significant. At levels exceeding 1.0%, however, they decrease the toughness of the heat-affected zone.

Nb: 0.005 to 0.1%, V: 0.01 to 0.1%, Ti: 0.005 to 0.03%

These elements are highly effective in increasing the strength of the steel, due to the precipitation hardening and increasing hardenability effects and also in improving the toughness through grain refining. The respective lower limit values indicate the levels at which these effects are produced. On the other hand, excessive amounts of these elements cause the toughness of the weld to decrease. The respective upper limits are the limits under which the desired characteristics should be secured.

Al: not more than 0.06%

Like Si, Al is effective as a deoxidizing agent. Even at a level of 0.06% or less, this effect can be produced to a sufficient extent. The addition at levels exceeding 0.06% is undesirable from the economical viewpoint. The Al content may be the same or below the impurity level. However, for securing the toughness of the weld metal, however, the Al content of not less than 0.02% is desirable.

B: 0.0005 to 0.0030%

At levels of not lower than 0.0005%, B markedly increases the hardenability of the steel. At levels exceeding 0.0030%, however, it lowers the weldability. Therefore, the appropriate B content is 0.0005 to 0.0030%.

N: not more than 0.005%

N forms nitrides with V, Ti etc., and thereby effectively improves the strength of the steel at elevated temperatures. However, when the N content exceeds 0.005%, N forms coarse carbonitrides with Nb, V and Ti and thereby lowers the toughness of the base metal and the heat affected zone. Therefore, the N content needs to be suppressed to 0.005% or less.

Ca: 0.0003 to 0.005%

Ca is effective in morphological control of inclusions, specifically rendering inclusions spherical, and prevents hydrogen-induced cracking or lamellar tearing. These effects become significant at the level of 0.0003% or higher and reach a point of saturation at 0.005%. Therefore, the content of Ca, when it is added, is recommendably 0.0003 to 0.05%.

4. Metallographic Structure

The steel pipe obtained must have a metallographic structure such that the area percentage of martensite and/or bainite is not less than 80%. Thus, it is required that martensite alone, bainite alone or a mixed structure composed of both should amount to at least 80% as expressed in terms of area percentage. When it has such a microstructure, the steel pipe can be a high-strength steel pipe having yield strength of not lower than 551 MPa.

A high-strength steel pipe, having such a metallographic structure as mentioned above, can be obtained in the following manner. A slab, having an appropriate chemical composition, is subjected to controlled rolling and controlled cooling in order to give a steel plate the above-mentioned metallographic structure. This is used as the base metal and subjected to the steps of forming, welding, and pipe expansion and reduction. The metallographic structure of the steel plate can be retained in the steel pipe after working.

5. Pipe Expansion Percentage and Pipe Reduction Percentage

Pipe expansion percentage: 0.3 to 1.2%

In order to reduce the stress remaining in the vicinity of the welded portion and for securing the pipe roundness, at least 0.3% of pipe expansion is required. On the other hand, pipe expansion, when carried out at a working rate of greater than 1.2%, causes more work hardening than needed, adversely affecting the mechanical properties. The method of pipe expansion may be either the mechanical expansion or hydraulic expansion, which should be carried out in the conventional UOE process.

In high-strength steel pipes, having a yield strength of not lower than 689 MPa (steel pipes of X100 or higher grade), the proportion of martensite in the metallographic structure becomes high. Therefore, the increase in yield ratio due to pipe expansion is also great. However, by the combination of pipe expansion and pipe reduction, according to the present invention, makes it possible to suppress the yield ratio from increasing and readily satisfy the requirement that the yield ratio should not be higher than 93%.

EXAMPLE

Steel plates of 10 to 25 mm in thickness, having the respective chemical compositions and microstructures shown in Table 1, were used as base metals in producing steel pipes having an outer diameter of 30 inches to 48 inches. The microstructure observation was conducted under an optical microscope and an electron microscope, and the proportions of martensite and bainite were determined.

First, each steel sheet was subjected to C—U—O press forming, tack welding, internal welding and external welding by the SAW method, followed by mechanical pipe expansion and pipe reduction using an O-press. The expansion percentage and reduction percentage are shown in Table 2.

TABLE 1

Testing Steels

| Steel | Chemical Composition (mass %, bal.: Fe) | | | | | | | | | | | | | | | Micro-Structure (Ratio of |
|---|---|---|---|---|---|---|---|---|---|---|---|---|---|---|---|---|
| Nos. | C | Si | Mn | P | S | Cu | Cr | Ni | Mo | Nb | V | Ti | Al | N | B | M + B, %) |
| a | 0.04 | 0.09 | 1.55 | 0.006 | 0.001 | 0.30 | 0.29 | 0.62 | 0.40 | 0.018 | 0.032 | 0.015 | 0.023 | 0.0024 | 0.0012 | 100 |
| b | 0.06 | 0.09 | 1.84 | 0.006 | 0.001 | 0.30 | 0.04 | 0.50 | 0.26 | 0.029 | — | 0.019 | 0.028 | 0.0039 | — | 98 |
| c | 0.07 | 0.26 | 1.60 | 0.007 | 0.002 | 0.27 | 0.18 | 0.47 | 0.01 | 0.045 | 0.066 | 0.018 | 0.025 | 0.0042 | — | 81 |
| d | 0.08 | 0.14 | 1.56 | 0.013 | 0.003 | — | — | — | — | 0.041 | 0.054 | 0.018 | 0.036 | 0.0048 | — | 72 |

Note)
1. "—" means no addition.
2. In "Micro-Structure", M and B mean martensite and bainite respetively. Ratio (%) means the ratio of total area of M and B.

Pipe reduction percentage: 0.1 to 1.0%

For canceling the work hardening resulting from pipe expansion and also in order to attain a low yield ratio through the Bauschinger effect, working which causes at least 0.1% of perset distortion, namely pipe reduction, is necessary. On the other hand, when pipe reduction greater than 1.0% is conducted, it is difficult to secure the intended pipe shape and size and, in addition, local deformation may take place, possibly causing irregularity in performance in the direction of the circumference of the pipe. Further, a decrease in toughness results, as mentioned above referring to FIG. 3. Even if pipe reduction exceeding 1.0% could be realized under a high load, the yield ratio decreases markedly, so that some measures for increasing the tensile strength, for example addition of an alloying component or components, becomes necessary for securing the desired yield strength. This, however, leads to an increase in production cost.

It is desirable that the pipe reduction percentage be smaller than the pipe expansion percentage. When pipe reduction is carried out at a higher working ratio than the pipe expansion percentage, the decrease in yield ratio may become excessive.

The pipe expansion percentage, pipe reduction percentage, the results of Charpy impact test and tensile test, and the roundness are shown in Table 2. The items, Charpy impact value, tensile characteristics and roundness are particularly important items to be checked for assuring the performance characteristics of line pipes.

The impact test specimens used were JIS No. 4 specimens, and the tensile test specimens used were round bar specimens. The absorbed energy, yield strength and tensile strength at −30° C. were measured, and the yield ratio was calculated. The results obtained are shown in Table 2. For impact strength value determination, test specimens with the notch on the base metal, weld metal or fusion line were collected. In the roundness column, "O" indicates that diameter values are within the API specification range "nominal outside diameter ±1%", and "X" indicates failure to fall within this tolerance range. The symbol Δ means that the load on equipment for attaining a satisfactory level of circularity is very heavy.

TABLE 2

Conditions of Pipe Production and Test Results

| Test Nos. | Steel Nos | Ratio of "Pipe Thickness/Pipe Outer Diameter" (t/D) × 100% | Expansion Ratio % | Reduction Ratio % | Charpy Inpact Value ($vE_{-30}$) Base Metal | Weld Metal | Fusion Line | Tensile Test Results (MPa) Yield Strength | Tensile Strength | Yield Ratio % | Micro-Structure Ratio of M + B, %) | Round-ness | Evalu-ation | Cat-egory |
|---|---|---|---|---|---|---|---|---|---|---|---|---|---|---|
| 1 | a | 1.9 | 0.5 | 0.3 | ○ | ○ | ○ | 876 | 984 | 89 | 100 | ○ | ○ | ex. |
| 2 | a | 1.9 | 0.1 | 0.3 | ○ | ○ | ○ | 819 | 961 | 85 | 100 | x | x | c.e. |
| 3 | a | 1.9 | 1.6 | 0.3 | ○ | ○ | ○ | 962 | 1023 | 94 | 100 | Δ | x | c.e. |
| 4 | a | 1.9 | 1.0 | | ○ | ○ | ○ | 981 | 1001 | 98 | 100 | ○ | x | c.e. |
| 5 | a | 1.9 | 1.0 | 1.2 | x | ○ | ○ | 835 | 1006 | 83 | 100 | Δ | x | c.e. |
| 6 | b | 2.1 | 0.5 | 0.6 | ○ | ○ | ○ | 698 | 862 | 81 | 98 | ○ | ○ | ex. |
| 7 | b | 2.1 | 0.1 | 0.3 | ○ | ○ | ○ | 631 | 799 | 79 | 97 | x | x | c.e. |
| 8 | b | 2.1 | 1.0 | | ○ | ○ | ○ | 796 | 847 | 94 | 96 | ○ | x | c.e. |
| 9 | b | 2.1 | 1.7 | 0.3 | ○ | ○ | ○ | 813 | 865 | 94 | 98 | ○ | x | c.e. |
| 10 | b | 2.1 | 1.0 | 1.3 | x | ○ | ○ | 664 | 841 | 79 | 97 | ○ | x | c.e. |
| 11 | c | 2.2 | 0.7 | 0.4 | ○ | ○ | ○ | 555 | 677 | 82 | 83 | ○ | ○ | ex. |
| 12 | c | 2.2 | 0.1 | 0.4 | ○ | ○ | ○ | 478 | 655 | 85 | 81 | x | x | c.e. |
| 13 | c | 2.2 | 1.0 | | ○ | ○ | ○ | 542 | 689 | 92 | 81 | ○ | x | c.e. |
| 14 | c | 2.2 | 1.7 | 0.3 | ○ | ○ | ○ | 665 | 707 | 94 | 82 | ○ | x | c.e. |
| 15 | c | 2.2 | 1.0 | 1.4 | ○ | ○ | ○ | 548 | 694 | 79 | 83 | Δ | x | c.e. |
| 16 | d | 2.3 | 1.0 | | ○ | ○ | ○ | 517 | 587 | 88 | 75 | ○ | x | c.e. |
| 17 | d | 4.2 | 1.0 | | ○ | ○ | ○ | 560 | 596 | 94 | 71 | ○ | x | c.e. |
| 18 | d | 4.2 | 0.8 | 0.4 | ○ | ○ | ○ | 521 | 592 | 88 | 72 | ○ | x | c.e. |

Note)
1. In "Charpy Inpact Value": "○" means 200 J or more for base metal, and 40 J or more for Weld Metal and Fusion Line
2. In "Roundness": "○" means to satisfy API specification, "x" means out of the specification and "Δ" means over-load of equipments.
3. Blank in "Reduction Ratio" means no-applied.
4. In "Category", "ex." means example of this invention and "c. e." means comparative examples.

As is apparent from Table 2, in each of the examples, according to the present invention, the microstructure of the base steel plate satisfied the prescribed conditions and the pipe was produced at an adequate pipe expansion percentage and reduction percentage and, therefore, the absorbed energy values for the base metal, weld metal and fusion line exceeded 200 J, 40 J and 40 J, respectively, and the toughness was thus high. In addition, the strength was adequate and the circularity was good.

In the comparative examples, on the other hand, the metallographic structure fraction was not adequate, or the pipe expansion percentage and/or pipe reduction percentage was inadequate even when the structure was appropriate, so that the yield ratio reducing effect was slight, and the yield ratio exceeded the target level of 93%. Furthermore, when the strength was higher and the pipe reduction percentage was high, the base metal toughness decreased.

EFFECT OF THE INVENTION

The method of the present invention can solve the excessively high yield ratio problem intrinsic in high-strength steel pipes and can secure their safety as actual line pipes. It can produce steel pipes excellent in toughness as well as in circularity. The method of the present invention is very useful as a method of producing high-strength steel pipes, and the steel pipes produced can be put to practical use as line pipes of X80 or higher grade.

What is claimed is:

1. A method of producing a steel pipe having a microstructure at least 80%, as expressed in terms of area percentage, of which comprises martensite and/or bainite and having a yield strength of not lower than 551 MPa; comprising a step of forming and welding a steel plate into a steel pipe, expanding, by 0.3 to 1.2%, the steel pipe, and then reducing the expanded steel pipe by 0.1 to 1.0%.

2. A method of producing a steel pipe according to claim 1, wherein the percentage of pipe reduction is smaller than the percentage of pipe expansion.

3. A method of producing a steel pipe according to claim 1, wherein the steel pipe after expansion and reduction has a yield strength of not lower than 689 MPa.

4. A method of producing a steel pipe according to claim 2, wherein the steel pipe after expansion and reduction has a yield strength of not lower than 689 MPa.

5. A welded steel pipe produced by any of the methods according to claims 1 to 4.

6. A welded steel pipe produced by the method according to claim 2.

7. A welded steel pipe produced by the method according to claim 3.

8. A welded steel pipe produced by the method according to claim 4.

* * * * *

UNITED STATES PATENT AND TRADEMARK OFFICE

CERTIFICATE OF CORRECTION

PATENT NO. : 6,948,649 B2
DATED : September 27, 2005
INVENTOR(S) : Nobuaki Takahashi et al.

It is certified that error appears in the above-identified patent and that said Letters Patent is hereby corrected as shown below:

Column 10,
Line 48, delete “any of”.
Line 48, delete “methods” and insert -- method --.
Line 49, delete “claims 1 to 4” and insert -- claim 1 --.

Signed and Sealed this

Twenty-seventh Day of December, 2005

JON W. DUDAS
*Director of the United States Patent and Trademark Office*